United States Patent [19]

Speich

[11] Patent Number: 4,657,051

[45] Date of Patent: Apr. 14, 1987

[54] WEAVING MACHINE

[76] Inventor: Francisco Speich, Bleumattstrasse 10, 5264 Gipf-Oberfrick, Switzerland

[21] Appl. No.: 571,450

[22] Filed: Jan. 17, 1984

[30] Foreign Application Priority Data

Jan. 18, 1983 [CH] Switzerland ..... 250/83

[51] Int. Cl.[4] ..... D03D 51/02

[52] U.S. Cl. ..... 139/1 E

[58] Field of Search ..... 139/1 E, 1 R, 317

[56] References Cited

U.S. PATENT DOCUMENTS 4,398,568 8/1983 Rydborn ..... 139/1 R 4,474,220 10/1984 Palau ..... 139/1 E 4,478,254 10/1984 Beaudoux ..... 139/1 E

*Primary Examiner*—Werner H. Schroeder

*Assistant Examiner*—Joseph S. Machuga

*Attorney, Agent, or Firm*—Toren, McGeady and Goldberg

[57] ABSTRACT

In the weaving machine warp threads (24) are guided from a warp let-off apparatus (2) via a shedding apparatus (6) to a fabric take-up apparatus (4). The weaving machine contains a main drive (8) at which are connected a weaving reed (14) and a filling thread inserting element (16). In addition, an auxiliary drive shaft (46) is connected at the main drive (8), which auxiliary drive shaft (46) drives the warp let-off apparatus (2), the fabric take-up apparatus (4) and the shedding apparatus (6). A common drive shaft (66) of the warp let-off apparatus (2) and of the fabric take-up apparatus (4) is connected with the auxiliary drive shaft (46) via a reversing gear unit (10). The reversing gear unit (10) is constructed as a superimposed gear unit and contains an auxiliary motor (90) in order to superimpose a reverse rotational movement of the warp let-off apparatus (2) and the fabric take-up apparatus (4). An electronic control apparatus (12), which is connected with the shedding apparatus (6) and the reversing gear unit (10), makes it possible to reverse the weaving program when the weaving machine is running forward.

5 Claims, 6 Drawing Figures

WEAVING MACHINE

BACKGROUND OF THE INVENTION

The invention is directed to a weaving machine which includes a shedding apparatus, a fabric take-up apparatus, a warp let-off apparatus, a main drive, a reversible control apparatus for a weaving program and a reversing gear unit for filling thread.

A weaving machine of the type mentioned above is known from DE-PS No. 625 733. For pick-finding the regulator, i.e., the fabric take-up apparatus, is stopped and the reversing gear unit reverses the shedding apparatus and the control apparatus, which are formed from the dobby and a card cylinder. Such a construction of the apparatus for pick-finding is suitable only for weaving machines which operate slowly and entails the danger that starting places will be visible in the fabric layer when starting the weaving machine again.

SUMMARY OF THE INVENTION

It is the object of the invention to construct a weaving machine of the type mentioned above in such a way that pick-finding is possible in a rapidly running weaving machine without the danger of defective areas in the fabric layer.

This object is met by operating the control apparatus electronically so that the weaving program can be reversed when the shedding apparatus of the weaving machine is running forward and is connected with the reversing gear unit for automatic control. The control possibilities and the response speed are substantially improved by means of the electronic construction of the control apparatus. The connection of the control apparatus with the reversing gear unit makes it possible to control accurately and automatically the reversing gear unit, so that the letter can be optimally adjusted automatically to the respective pick-finding process. By means of electronically reversing the weaving program when the shedding apparatus is running forward, there is the additional advantage that the shedding apparatus can be designed according to optimum high output criteria so as to eliminate reverse running. Since the reversing gear unit must only influence the fabric take-up apparatus and, possibly, the warp let-off apparatus, it is arranged in the auxiliary drive of the weaving machine and can accordingly be constructed so as to be substantially simpler and lighter.

In simple cases it can be sufficient to drive the reversing gear unit via a switching clutch of the main drive. A fixed drive speed can thereby be superimposed on the fabric take-up apparatus and possibly on the warp let-off apparatus during operation of the weaving machine, which drive speed makes it possible to stop or guide back the produced fabric and the warp threads. A construction where the reversing gear unit is connected with an auxiliary motor is advantageous, since the flexibility and the capability of employing the reverse gear unit is thereby increased. The reverse gear unit can then be actuated, for example, parallel with the running weaving machine. It is thereby possible, for example, to discontinue the fabric take-up and to relax the warp as is required, for example, to change the pick number per fabric length or to retension the warp threads.

Another construction of the weaving machine with a braking device assinged to the reversing gear unit is particularly advantageous for preventing lagging of the reversing gear unit and, accordingly, to increase the precision of the weaving machine.

A construction of the weaving machine where the reversing gear unit is provided as a superimposed or override gear unit is particularly advantageous, since a disengagement of the fabric take-up apparatus and possibly the warp let-off apparatus from the main drive of the weaving machine is not necessary.

A construction of the weaving machine where the shedding apparatus and possibly the reversing gear unit are controlled by the electronic control apparatus which includes a processor is advantageous, since a fully automatic operation of the weaving machine is made possible thereby.

It may also be advisable to construct the weaving machine with the shedding apparatus connected to the main drive by a switching clutch so that the shedding apparatus can be disengaged from the main drive if need be.

The shedding apparatus can be constructed as a treadle apparatus, but it is preferable to construct it as a dobby.

BRIEF DESCRIPTION OF THE DRAWING

Embodiment examples of the weaving machine are described in more detail in the following with the aid of schematic drawings. Shown are.

DETAILED DESCRIPTION OF THE DRAWING

Figure 1:
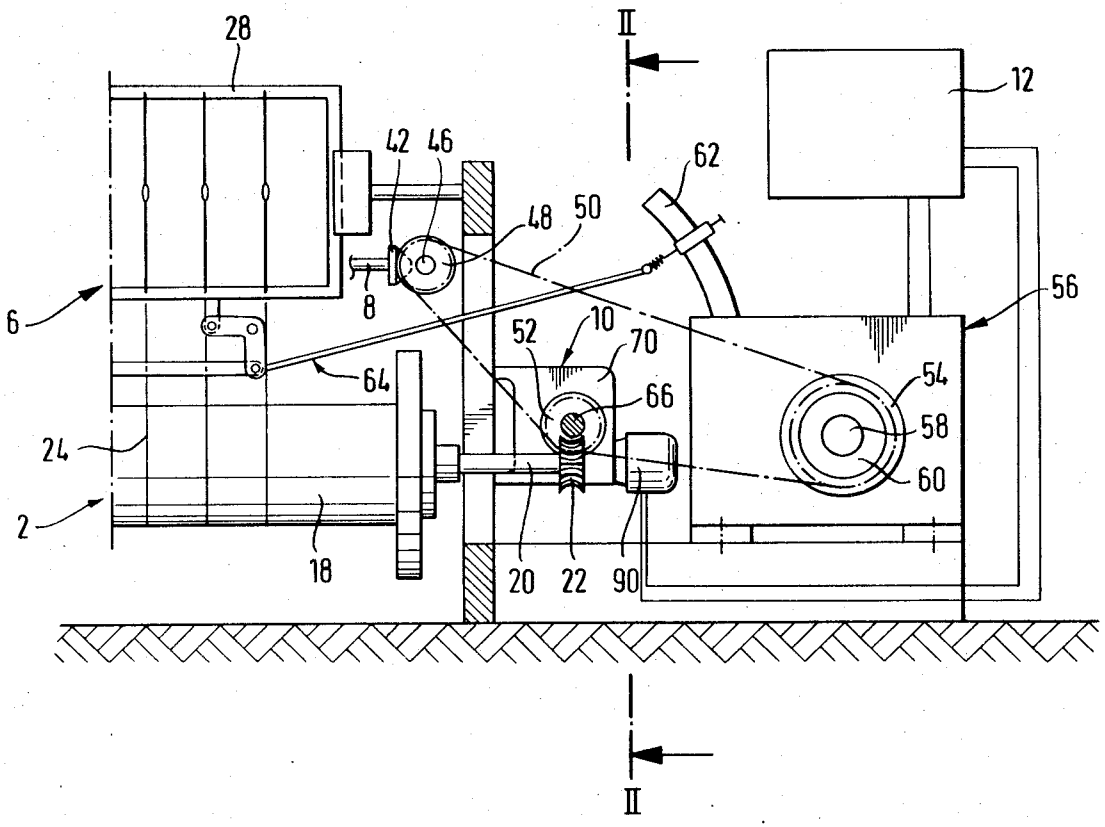
FIG. 1 a weaving machine in section and a front view of the warp let-off apparatus.
Figure 2:
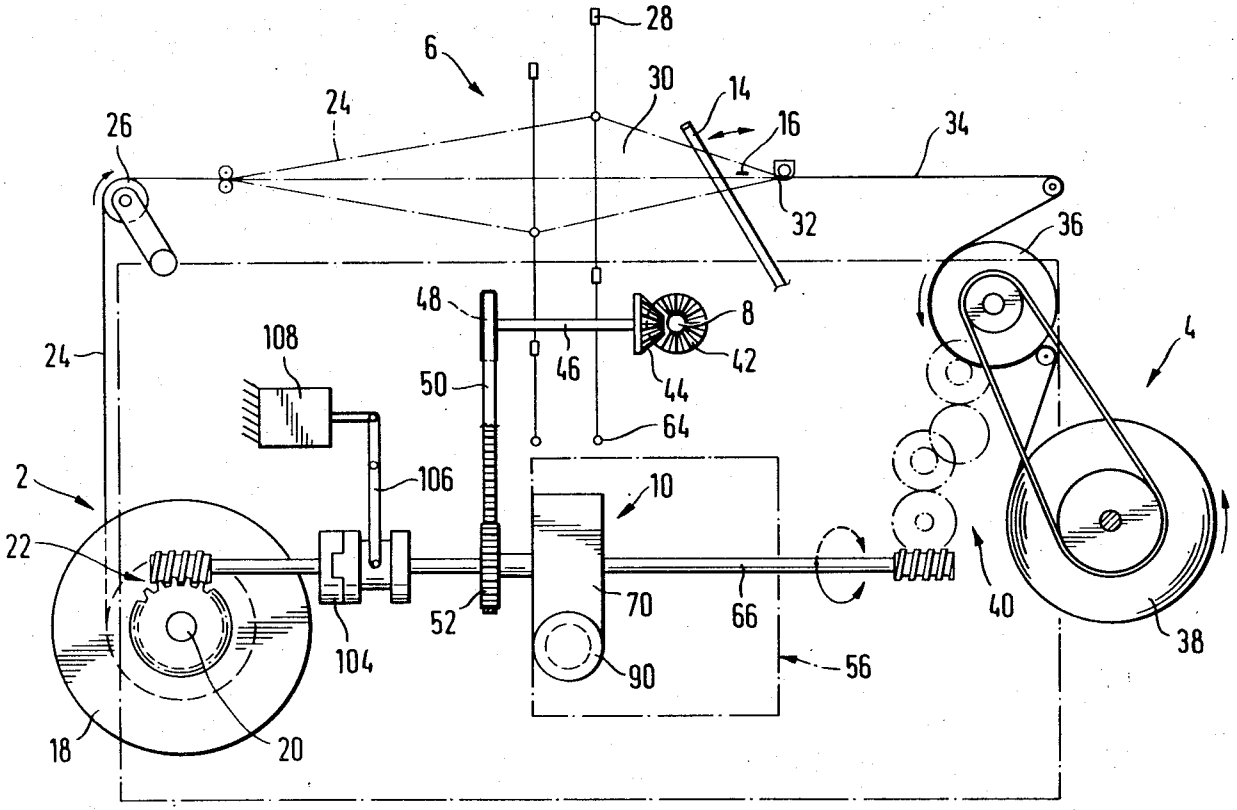
FIG. 2 the weaving machine of FIG. 1 taken along section line II—II of FIG. 1.
Figure 3:
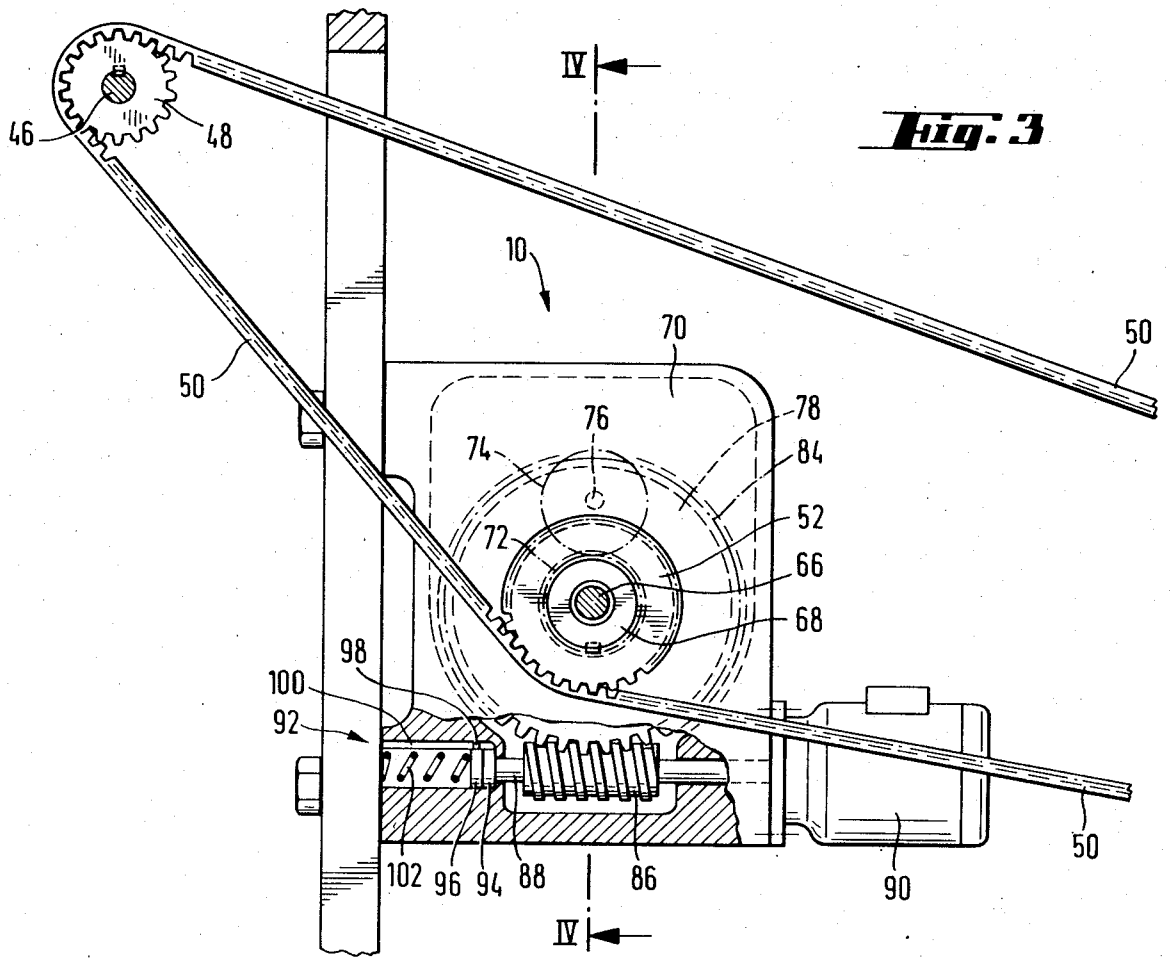
FIG. 3 side view of the reversing gear unit.
Figure 4:
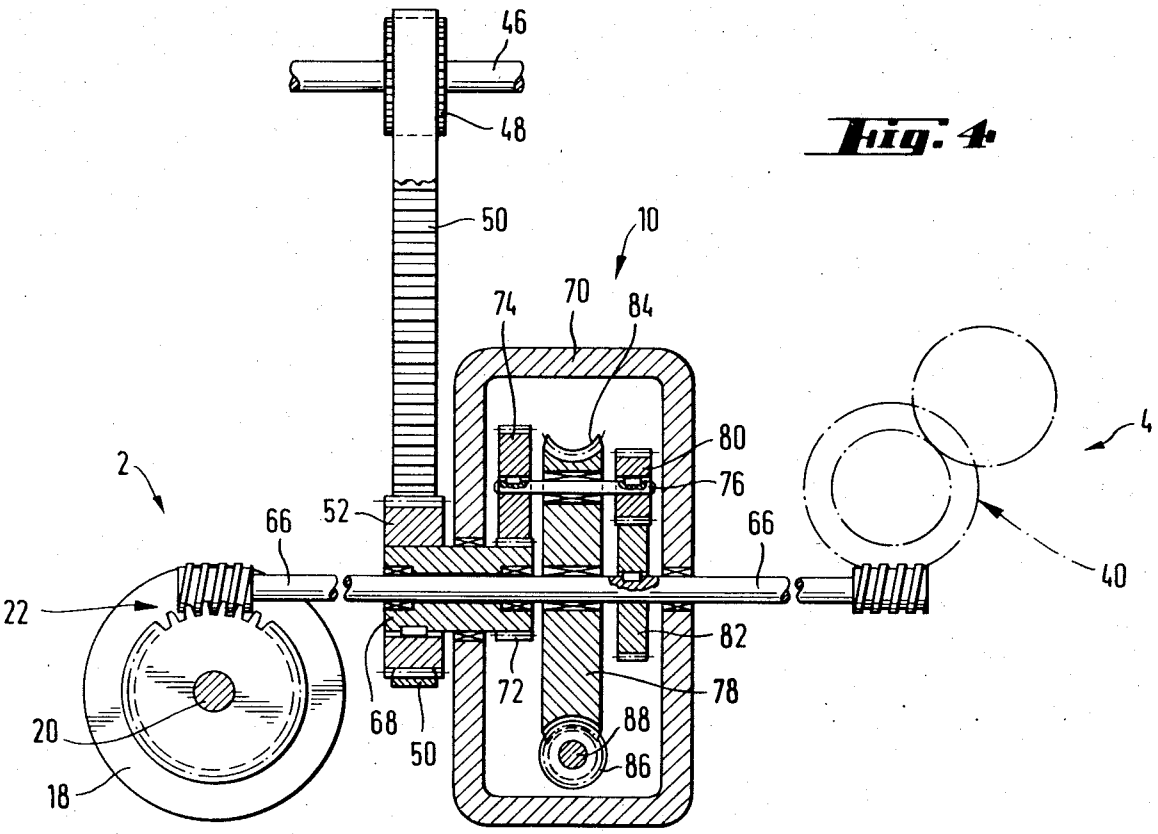
FIG. 4 the reversing gear unit taken along secton line IV—IV of FIG. 3.

FIGS. 1 through 4 show a first embodiment example of a weaving machine comprising a warp let-off apparatus 2, a fabric take-up apparatus 4, a shedding apparatus 6, a main drive 8 with a drive motor, not shown in more detail, a reversing gear unit 10 connected with the warp let-off apparatus 2 and the fabric take-up apparatus 4, as well as an electronic control apparatus 12. A weaving reed 14 and a filling thread inserting element 16 are connected at the main drive 8 in a manner known, for example, from CH-PS No. 633 331 and not shown in more detail.

The warp let-off apparatus 2 contains a warp beam 18 whose shaft 20 is driven via a worm gear unit 22. The warp threads 24 extend from the warp beam 18 over a back rest 26 to the shafts 28 of the shedding apparatus 6, which warp threads 24 serve to form and alternate the warp shed 30. The filling thread inserting element 16 periodically engages in the warp shed 30. The inserted filling thread is beaten at the fabric border 32 by means of the weaving reed 14. The woven fabric 34 is tensioned via the pull beam 36 and removed and rolled up on the fabric beam 38. The fabric take-up apparatus 4, containing the pull beam 36 and the fabric beam 38, is driven via a regulating gear unit 40.

An auxiliary drive shaft 46 is connected at the main drive via bevel gears 42, 44 for driving the warp let-off apparatus 2, the fabric take-up apparatus 4 and the shedding apparatus 6. This auxiliary drive shaft 46 carries a toothed wheel 48 which drives a drive wheel 52 for the warp let-off apparatus 2, the fabric take-up apparatus 4, as well as a drive wheel 54 for the shedding apparatus 6 via a toothed belt 50.

The shedding apparatus 6 contains a dobby 56 whose drive shaft 58 is connected with the drive wheel 54, possibly with the intermediary of a switching clutch 60. The dobby 56, which is constructed and controlled, for example, according to the European Offenlegungsschriften Nos. 0 056 098 and 0 068 139, has shaft swing arms 62, each of which is connected with a shaft 28 via a lever drive 64.

The drive wheel 52 for driving the warp let-off apparatus 2 and the fabric take-up apparatus 4 is connected with a drive shaft 66 via the reversing gear unit 10, which is constructed as a superimposed or override gear unit; which drive shaft 66 drives the worm gear unit 22 of the warp let-off apparatus 2 on the one hand and the regulating gear unit 40 of the fabric take-up apparatus 4 on the other hand. The drive wheel 52 is arranged at a bearing sleeve 68 which is supported on the drive shaft 66 so as to be freely rotatable. The bearing sleeve 68 projects into a housing 70 and carries a toothed wheel 72 with which a planet wheel 74 meshes. The latter is arranged rigidly for rotation at a shaft 76 which is rotatably supported in a planet or satellite carrier 78, which in turn is rotatably supported on the drive shaft 66. On the other side of the planet carrier 78 another planet wheel 80 is connected rigidly for rotation with the shaft 76. The second planet wheel 80 meshes with a toothed wheel 82 which is arranged rigidly for rotation at the drive shaft 66. The planet carrier 78 is constructed as a worm gear and contains a worm toothing 84 at its circumference which interacts with the worm wheel 86 whose drive shaft 88 is connected with an auxiliary motor 90. The worm gear unit formed from the worm toothing 84 and the worm wheel 86 is preferably constructed so as to be self-locking.

Accordingly, in forward or normal operation, the wheel 48 drives the belt 50 which in turn drives the drive wheel 52. Drive wheel 52 drives the bearing sleeve 68 and the wheel 72 on the bearing sleeve drives the planet wheel 74 which rotates the shaft 76 and, in turn, drives the second planet wheel 80. The meshed arrangement between the second planet wheel 80 and the wheel 82 drives the shaft 66 which, in turn, drives the fabric take-up apparatus 4. The arrangement just described provides the forward or normal operating movement of the take-up apparatus 4. In this case the auxiliary motor and the planet carrier stand still.

To achieve pick finding and reverse the direction of rotation of the fabric take-up apparatus 4, the electronic control apparatus 12 commences the operation of the auxiliary motor 90. Though not shown in FIG. 4, the auxiliary motor 90 drives the drive shaft 88 on which a worm wheel 86 is secured. The worm wheel 86 is in meshed engagement with the worm toothing 84 on the periphery of the planet carrier 78. Accordingly, the auxiliary motor 90 drives the planet carrier around the drive shaft 66. With the rotation of the planet carrier 78 the planet wheels 74 and 80 are carried along by the shaft 76 passing through the planet carrier. Accordingly, the wheel 82 is rotated and rotates the drive shaft 66 so that the desired reversal in direction of the take-up apparatus 4 is effected. The planet wheels 74 and 80 will be driven by the rotation of the planet carrier around the shaft 66. If the main drive is stopped then the bearing sleeve 68 and the wheel 72 also stand still so that the motion of the shaft 66 depends only on the rotation of the planet carrier driven by the auxiliary motor. If however, the main drive is operating, the rotation of the planet carrier 78 causes an additional motor superimposed to that of the wheel 72 driven by the main drive. Depending on the amount and direction of rotation of the planet carrier the resulting motion of the shaft 66 can be higher or lower or even reversed with respect to the motion resulting from the drive when the planet carrier is standing still. Accordingly, the override gear unit in the reversing gear unit affords the reversal in the direction of movement of the fabric take-up apparatus 4 while the main drive continues to operate the other parts of the weaving machine so that they run in the forward direction.

Moreover, the reversing gear unit 10 is equipped with a braking device 92 for preventing lagging. The braking device 92 has a friction disk 94 which is arranged rigidly for rotation on the drive shaft 88 and a friction disk 96 arranged rigidly for rotation in the housing 70 interacts with it. A peg 98 arranged at the friction disk 96 engages in a groove 100 in the housing 70 and is arranged parallel relative to the drive shaft 88 and prevents the friction disk 96 from turning. A pretensioning spring 102 pretensions the stationary friction disk 96 against the friction disk 94 connected with the drive shaft 88.

The drive shaft 66 is interrupted at the part going to the warp let-off apparatus 2 by means of a switching clutch 104. This switching clutch is constructed, e.g., as a claw clutch which is switchable via a switching lever 106 and an actuating device 108, so that the drive of the warp let-off apparatus 2 can be switched off if need be.

The weaving machine is equipped with the electronic control apparatus 12 which is connected on the one side with the dobby 56 of the shedding apparatus 6 and, on the other side, with the auxiliary motor 90 of the reversing gear unit. The electronic control apparatus, which is advisably provided with a processor, makes it possible to reverse the weaving program when the weaving machine is running forward, so that the dobby 56—although it is driven in the forward direction—executes a reverse movement course. At the same time, the control apparatus controls the auxiliary motor 90 of the reversing gear unit 10, so that the warp let-off apparatus 2 and the fabric take-up apparatus 4 can be reversed for the purpose of pick-finding.

The reverse gear unit also brings about the advantage that the fabric take-up apparatus 4 and possibly the warp let-off apparatus 2 can be set forward or set back even when the weaving machine is not in operation.

Figure 5:
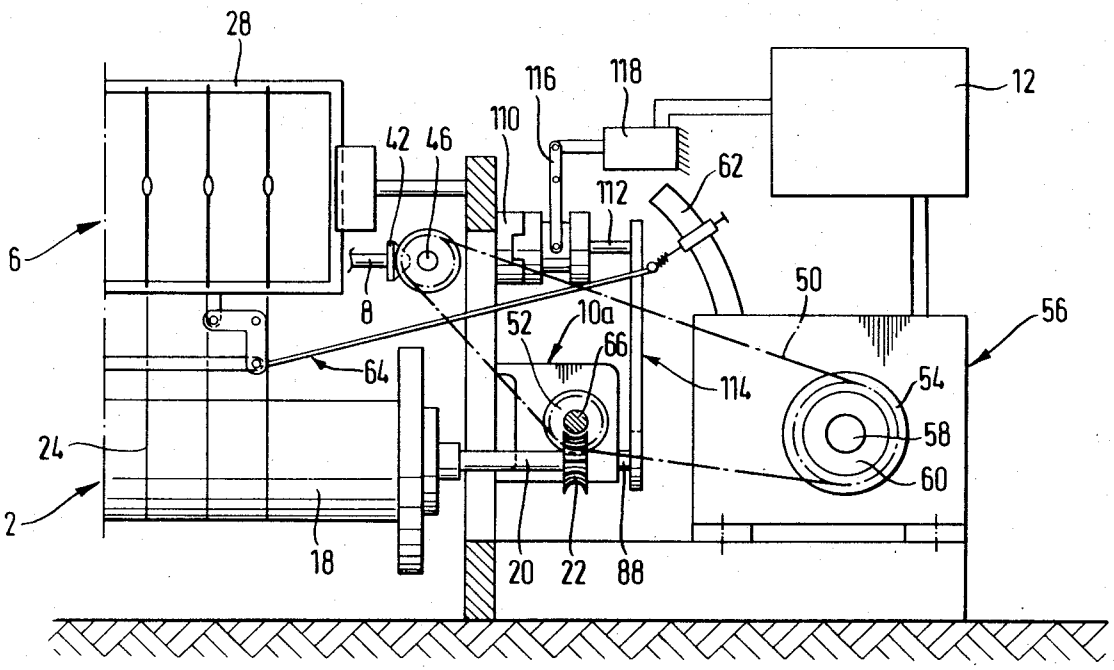
FIG. 5 a modified weaving machine according to FIG. 1.

FIG. 5 shows the weaving machine of FIG. 1, wherein, however, the drive of the reversing gear unit **10*a* is not effected via an auxiliary motor, but rather via the main drive 8 of the weaving machine. For this purpose, an auxiliary drive shaft 112 is connected at the main drive 8 via a switching clutch 110, which auxiliary drive shaft 112 drives the drive shaft 88 of the reversing gear unit 10*a* via a toothed belt drive 114. The remaining construction of the reversing gear unit 10*a* corresponds to that of FIGS. 3 and 4. The switching clutch 110 is constructed, for example, as a claw clutch, wherein a switching lever 116 is connected with an actuating device 118, which, in turn, is connected at the electronic control apparatus 12. This reversing gear unit 10*a* can be actuated only when the main drive 8** is running.

Figure 6:
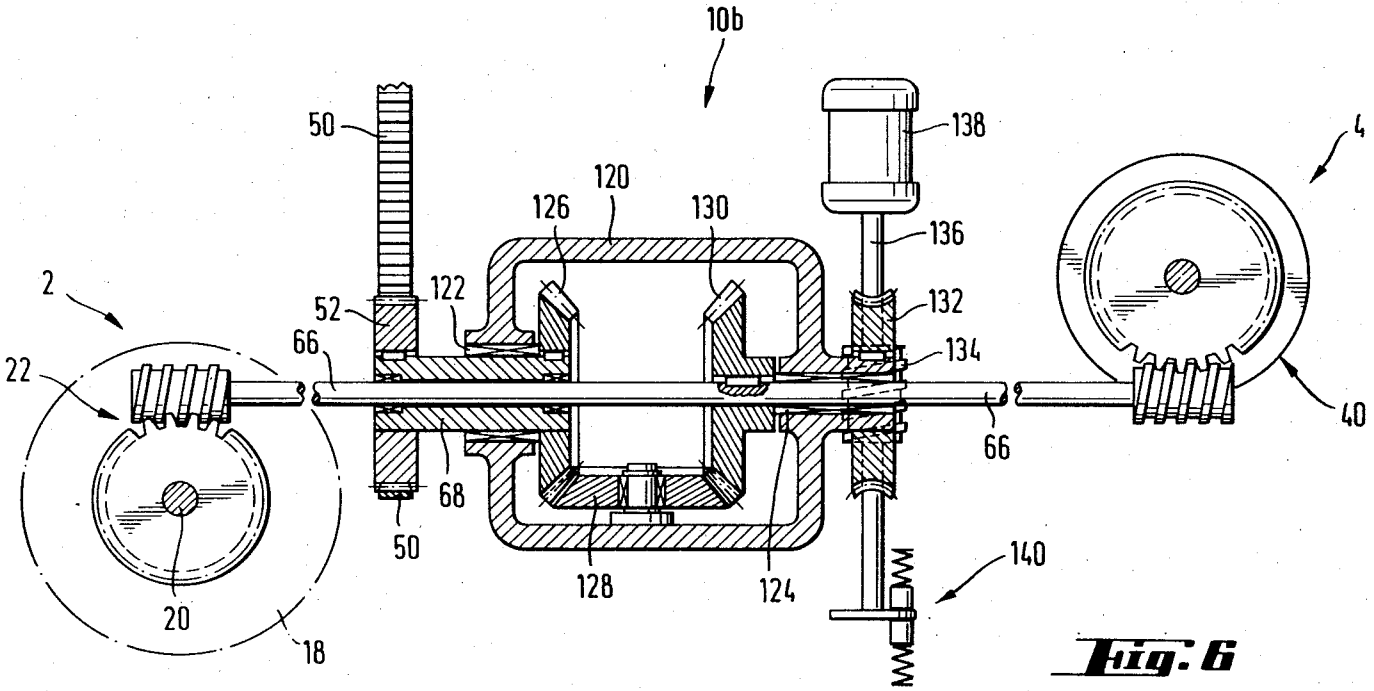
FIG. 6 another reversing gear unit in section according to FIG. 4.

FIG. 6 shows another reversing gear unit **10*b* which is in turn arranged on the drive shaft 66. The drive wheel 52 connected with the main drive 8 is, in turn, rotatably arranged on the drive shaft 66 via the bearing sleeve 68 and projects into a housing 120 which is rotatably supported on one side on the bearing sleeve 68 by means of a bearing 122 and, on the other side, on the drive shaft 66 by means of a bearing 124. A bevel gear 126 is fastened at the bearing sleeve 68 within the housing 120, which bevel gear 126 meshes with a second bevel gear 128 which is rotatably supported in the housing 120. This second bevel gear 128 meshes in turn with a third bevel gear 130 which is arranged on the drive shaft 66 rigidly for rotation. At the housing 120 of the reverse gear unit 10***b*, a worm wheel 132 is fastened coaxially relative to the drive shaft 66, which worm wheel 132 interacts with a worm 134 whose drive shaft 136 is connected at an auxiliary motor 138.

Accordingly in forward or normal operation the belt 50 drives the drive wheel 52 which is keyed to the bearing sleeve 68 which is rotatably mounted relative the housing 120. At its end within the housing 120, the bearing sleeve 68 is keyed to a bevel gear 126. The bevel gear 126, in turn, rotates a second bevel gear 128 which is rotatably supported in the housing. The second bevel gear 128 is in meshed engagement with a third bevel gear 130 and drives the third bevel gear. The third bevel gear is keyed onto the shaft 66 so that it rotates the drive shaft. As pointed out above, the first bevel gear 126 is mounted on the bearing sleeve 68 which rotates relative to the shaft 66, it is the third bevel gear 130 which rotates the shaft 66 and provides the normal forward driving operation of the fabric take-up apparatus 4.

If there is a break in the filling thread 17, then the signal transmitted to the processor commences the pick finding procedure while the drive continues the forward movement of the shedding apparatus via the dobby, the auxiliary motor 138 is started up and drive the shaft 136 for effecting the override for reversing the rotating direction of the drive shaft 66. A worm 134 is secured on the drive shaft 136 and, in turn, rotates the worm wheel 132 fastened to the housing 120 and arranged coaxially with the drive shaft 66. The drive shaft 66 is rotatable relative to the housing 120. The auxiliary motor 138 and the drive shaft 136 via the worm 134 drive the worm wheel 132 and, in turn, the housing 120. With the second bevel gear 128 rotatably supported on the housing it rotates the third bevel gear 130 which drives the drive shaft 66. The function of the arrangement of FIG. 6 is similar to that in FIG. 4. Depending on the rotation or no rotation and further depending on the amount and direction of rotation of the auxiliary motor 138 the resulting motion of the shaft 66 can be higher or lower or even reversed with respect to the motion resulting from a still standing housing 120.

A braking device 140 serves to prevent the lagging of the reversing gear unit 10*b*. The mode of operation of the reversing gear unit 10*b* is similar to that of the reversing gear unit 10 of FIGS. 3 and 4. The function of the planet carrier of the reversing gear unit 10 is taken over by the housing 120 in the reversing gear unit 10*b*.

I claim:

1. Weaving machine comprising an electronically operated control apparatus (12) for operating a weaving program for the weaving machine, a shedding apparatus (6) including a dobby (56) and a first drive shaft (58) for driving said dobby, a main drive (8), a fabric take-up apparatus (4) capable of being driven in a first direction for take-up and in an opposite second direction, a warp let-off apparatus (2), a second drive shaft (66) interconnecting said warp let-off apparatus (2) and said fabric take up apparatus (4), means interconnecting said main drive (8) to said second drive shaft (66) and a reversing gear unit, said reversing gear unit comprises a second drive shaft for driving said fabric take-up apparatus, wherein the improvement comprises that said reversing gear unit includes an override gear unit, an auxiliary motor arranged to drive said override gear unit, said auxiliary motor is controlled by said control apparatus for driving said override gear unit for selectively overriding said main drive so that said fabric take-up apparatus can be selectively driven in the second direction while said interconnecting means remains connected to said main drive.

2. Weaving machine according to claim 1, characterized in that said reversing gear unit (10*a*) is connected with said warp let-out apparatus via a switching clutch (104).

3. Weaving machine according to claim 1, characterized in that said reversing gear unit has a third drive shaft (88) connected to said auxiliary motor (90), a braking device (92,) is incorporated into said reversing gear unit (10, 10*a*, 10*b*) in engagement with said third drive shaft to prevent lagging, said reversing gear unit includes a housing supporting said third drive shaft said braking device being formed from a stationary friction disk (96) mounted in said housing and a friction disk (94) connected with said third drive shaft (88,) of said reversing gear unit (10, 10*a*, 10*b*), a pretensioning spring located within said housing in contact with said stationary friction disk for pretensioning said friction disks against one another.

4. Weaving machine according to claim 1, characterized by said second drive shaft (66) for said fabric take-up apparatus (4) is connected with said warp let-off apparatus (2), said interconnecting means further includes a drive wheel (52) rotatably supported on said second drive shaft (66) and arranged to be driven by said main drive (8), said reversing gear unit includes a toothed wheel (72) connected with said drive wheel, a first planet wheel (74) in meshed engagement with said toothed wheel (72), a planet carrier 78 supporting said first planet wheel, said planet carrier is rotatably mounted on said drive shaft (66), a second planet wheel (80) is supported by said planet carrier (78), a toothed wheel (82) in meshed engagement with said second planet wheel, said toothed wheel (82) is arranged rigidly for rotation on said second drive shaft (66), and means for connecting said planet carrier (78) to said auxiliary motor.

5. Weaving machine according to claim 1, characterized in that said reversing gear unit (10*b*) includes a housing (120) rotatably mounted on said second drive shaft, said interconnecting means includes a drive wheel (52) rotatably supported on said second drive shaft (66) said reversing gear unit further comprises a first bevel gear (126) located in said housing and connected with said drive wheel (52), a second bevel gear (128) in meshed engagement with said first bevel gear, said housing (120) is rotatably supported on said drive shaft (66) and said second bevel gear is rotatably supported in said housing, a third bevel gear (130) located in said housing and disposed in meshed engagement with said second bevel gear (128), said third bevel gear (130) is arranged on said drive shaft (66) rigidly for rotation, and said override gear unit comprises a third drive shaft (136) driven by said auxiliary motor, a worm (134) secured on said third drive shaft and a worm wheel (132) secured to said housing (120) coaxially with said second drive shaft and said worm wheel interacts with said worm (134), wherein said worm gear unit (132, 134) is self-locking and connects auxiliary motor (138) to said housing (120).

* * * * *